US006230846B1

(12) United States Patent
Namba et al.

(10) Patent No.: US 6,230,846 B1
(45) Date of Patent: May 15, 2001

(54) ELEVATOR APPARATUS WITH CONTROL PANEL LOCATED WITHIN ELEVATOR HOISTWAY

(75) Inventors: Yasuhiro Namba; Shigeki Yamakawa, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/402,544

(22) PCT Filed: Jun. 16, 1998

(86) PCT No.: PCT/JP98/02645

§ 371 Date: Oct. 6, 1999

§ 102(e) Date: Oct. 6, 1999

(87) PCT Pub. No.: WO99/65812

PCT Pub. Date: Dec. 23, 1999

(51) Int. Cl.[7] ..... B66B 11/02
(52) U.S. Cl. ..... 187/394; 187/401; 187/414
(58) Field of Search ..... 187/391, 393, 187/394, 277, 279, 280, 298, 401, 413, 414

(56) References Cited

U.S. PATENT DOCUMENTS

| | | | | |
|---|---|---|---|---|
| 4,356,895 | * | 11/1982 | Kappenhagen et al. | 187/17 |
| 4,438,831 | * | 3/1984 | Rohana | 187/30 |
| 5,379,863 | * | 1/1995 | Sugawara et al. | 187/233 |
| 5,429,211 | * | 7/1995 | Aulakano et al. | 187/254 |
| 5,450,929 | * | 9/1995 | Ohgita et al. | 187/244 |
| 5,469,937 | * | 11/1995 | Hakalad et al. | 187/266 |
| 5,490,578 | * | 2/1996 | Aulakano et al. | 187/254 |
| 5,844,180 | * | 12/1998 | Liebetrau et al. | 187/394 |
| 6,006,866 | * | 12/1999 | Horne et al. | 187/316 |
| 6,021,873 | * | 2/2000 | Aulakano et al. | 187/411 |
| 6,026,937 | * | 2/2000 | Hayashi et al. | 187/401 |
| 6,039,152 | * | 3/2000 | Schops et al. | 187/414 |

FOREIGN PATENT DOCUMENTS

| | | | |
|---|---|---|---|
| 05162937 | * | 6/1993 | (JP) . |
| 710437 | | 1/1995 | (JP) . |
| 07237839 | * | 9/1995 | (JP) . |
| 07285752 | * | 10/1995 | (JP) . |
| 710434 | | 1/1996 | (JP) . |
| 9165172 | | 6/1997 | (JP) . |
| 10194621 | * | 7/1998 | (JP) . |

* cited by examiner

*Primary Examiner*—Jonathan Salata
(74) *Attorney, Agent, or Firm*—Leydig, Voit & Mayer, Ltd.

(57) ABSTRACT

In an elevator apparatus, a control panel is disposed below a lowermost movement position of a proximity switch projecting from a car. The control panel is mounted on a hoistway wall through a mounting bracket at a position which is overlapped by a cross-section of the proximity switch projected in the ascending and descending directions of the car. Namely, the control panel is mounted by utilizing the space below the movement range of the proximity switch. Also, a gap is present between the surface of the hoistway wall and the control panel by the mounting bracket.

9 Claims, 6 Drawing Sheets

ELEVATOR APPARATUS WITH CONTROL PANEL LOCATED WITHIN ELEVATOR HOISTWAY

TECHNICAL FIELD

The present invention relates to an elevator apparatus, and more particularly, to an elevator apparatus in which a control panel is installed within a hoistway.

BACKGROUND ART

In a conventional elevator apparatus, since a hoisting machine, a control panel and the like are installed in a machine room disposed at an upper portion of a hoistway, it is necessary to provide a space for the machine room at an uppermost portion of a building. Therefore, the utility efficiency of the building is degraded and the height of the building is increased.

In contrast, for example, Japanese Patent Application Laid-Open No. 7-10434 discloses an elevator apparatus in which a hoisting machine and a control panel are disposed in an uppermost portion of a hoistway to thereby dispense with a machine room. Also, Japanese Patent Application Laid-Open No. 7-10437 discloses an elevator apparatus in which a hoisting machine and a control panel are disposed in a bottom portion of a hoistway to thereby dispense with a machine room. However, in these elevator apparatuses, although the machine room may be dispensed with, it is possible that the height of the hoistway or the horizontal cross-sectional area of the hoistway may be increased.

Also, Japanese Patent Application Laid-Open No. 10-114481 discloses an elevator apparatus in which a control panel is disposed in a bottom portion of a hoistway. However, in this apparatus, in order to prevent the car from interfering with the control panel, a depression is formed on the bottom portion of the car. For this reason, the floor area of the car is decreased.

DISCLOSURE OF THE INVENTION

In order to overcome the above-noted defect, an object of the present invention is to provide an elevator apparatus in which the height of a building may be reduced without providing any depression in a car and which can enhance the utility efficiency of a building.

According to the present invention, there is provided an elevator apparatus comprising: a hoistway having a hoistway wall and a bottom portion; an ascending/descending body having a side wall portion facing the hoistway wall and a car-mounted device projecting toward the hoistway wall from the side wall portion, the ascending/descending body being raised and lowered within the hoistway; and a control panel for controlling the raising and lowering of the ascending/descending body, the control panel being disposed within the hoistway at a position that is overlapped by a region projected from the car-mounted device in the ascending/descending direction of the ascending/descending body, and out of the movement range of the car-mounted device in the ascending/descending direction of the ascending/descending body.

Also, according to the present invention, there is provided an elevator apparatus comprising: a hoistway having a hoistway wall and a bottom portion; an ascending/descending body for being raised and lowered within the hoistway; a hoistway device provided on the hoistway wall so as to project into the hoistway; and a control panel for controlling the raising/lowering of the ascending/descending body, the control panel being disposed within the hoistway at a position that is overlapped by a region projected from the hoistway device in the ascending/descending direction of the ascending/descending body, and out of the range of the hoistway device installation region.

BEST MODE FOR CARRYING OUT THE INVENTION

A preferred embodiment of the present invention will now be described with reference to the accompanying drawings.

First Embodiment

Figure 1:
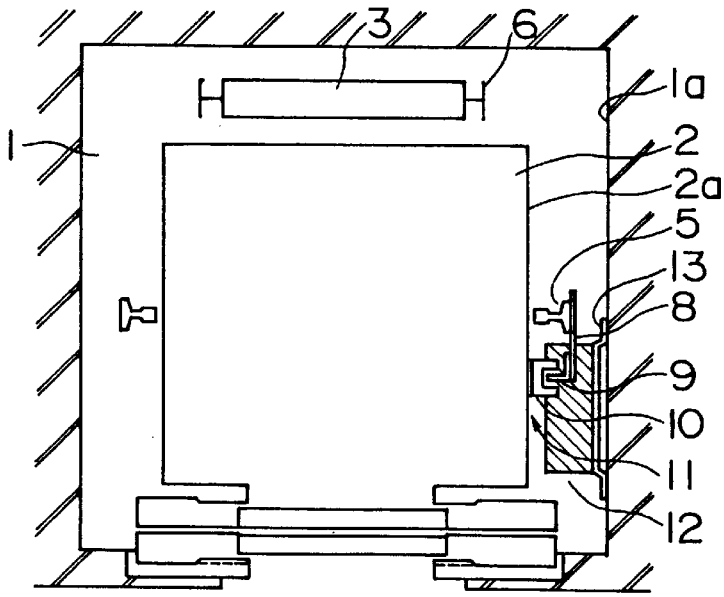
FIG. 1 is a horizontal cross-sectional view of an elevator apparatus according to a first embodiment of the present invention.
Figure 2:
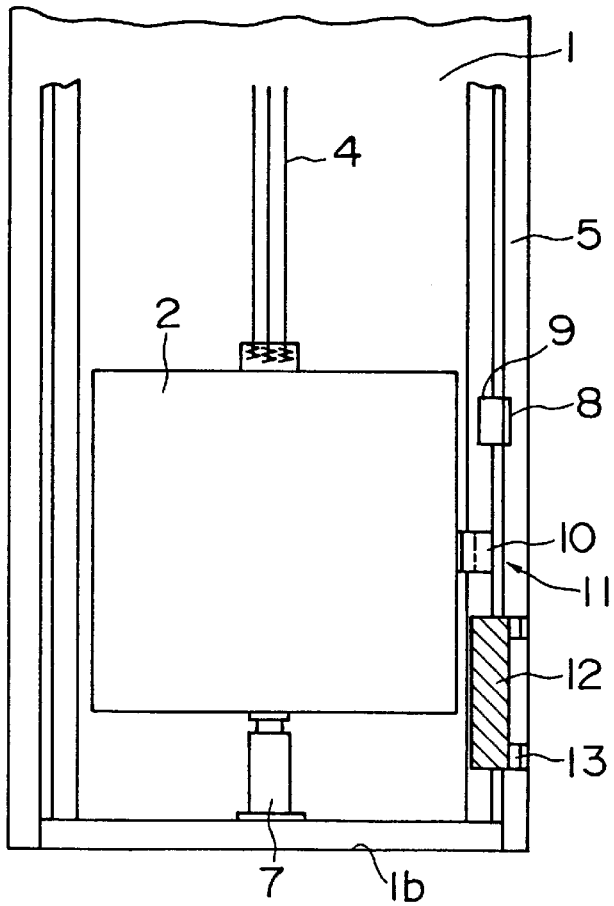
FIG. 2 is a vertical sectional view of the apparatus shown in FIG. 1.
Figure 3:
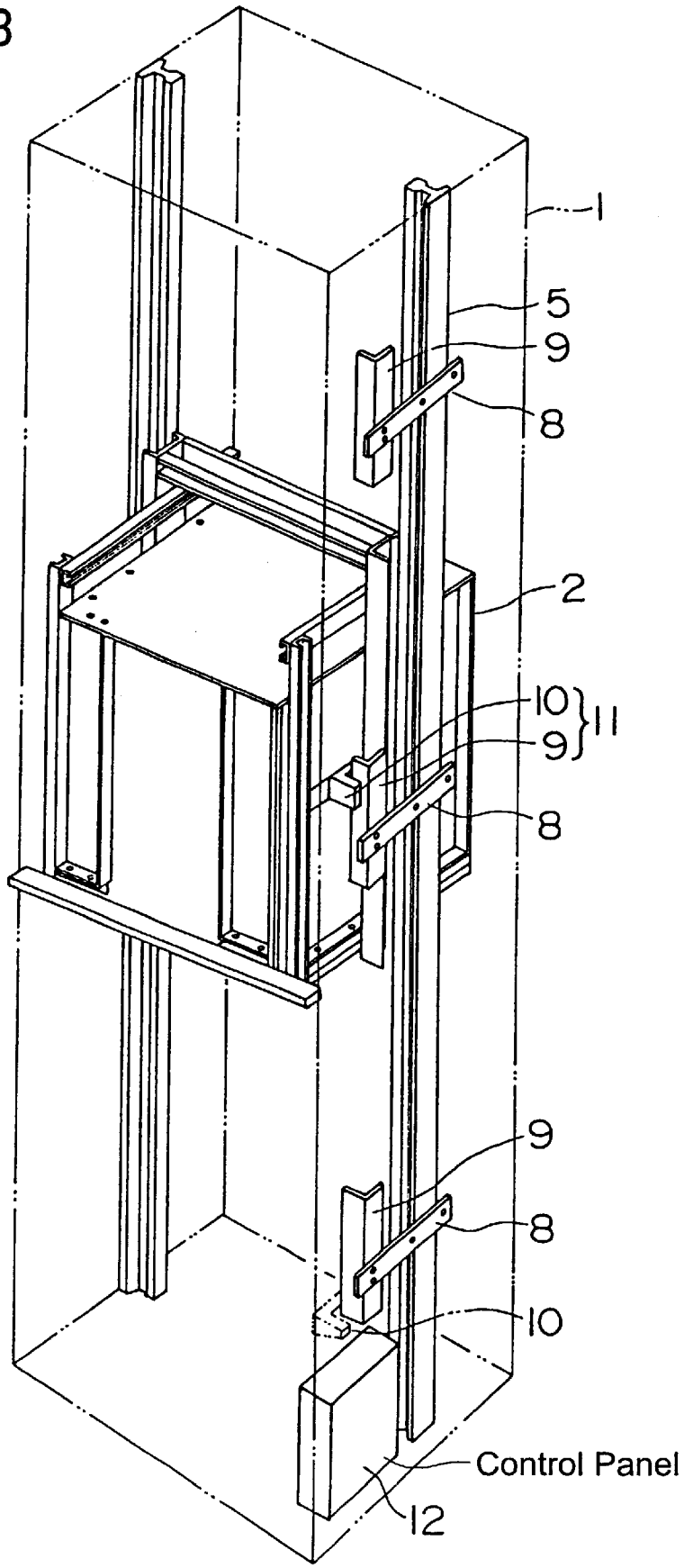
FIG. 3 is a perspective view showing a primary part of the apparatus shown in FIG. 1.

FIG. 1 is a horizontal cross-sectional view of an elevator apparatus according to a first embodiment of the present invention, FIG. 2 is a vertical sectional view of the elevator apparatus of FIG. 1, and FIG. 3 is a perspective view showing a primary part of the apparatus of FIG. 1. In the drawings, a car 2 which is an ascending/descending body for being raised and lowered within a hoistway 1 is suspended at one end portion of a main rope 4. A counter-weight 3 also serving as an ascending/descending body is suspended at the other end portion of the main rope 4. A pair of car guide rails 5 for guiding the vertical motion of the car 2 and a pair of weight guide rails 6 for guiding the vertical motion of the counter-weight 3 are provided within the hoistway 1, respectively.

Figure 4:
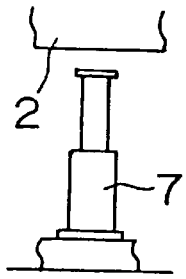
FIG. 4 is an illustration of a positional relationship between the car shown in FIG. 2 and a buffer device when the car is positioned at the lowermost floor.

A buffer device 7 for receiving the car 2 in case of emergency is provided at a bottom portion (pit portion) 1*b* of the hoistway 1. FIG. 2 shows a condition in which the car 2 is received by the buffer device 7. During normal operation, as shown in FIG. 4, even if the car 2 reaches the lowermost floor, a gap exists between the car 2 and the buffer device 7.

A plurality of landing plates 9 are mounted through mounting arms 8 on the car guide rail 5. A proximity switch 10 is provided as car-mounted device facing the landing plates 9 at a side wall portion 2*a* of the car 2 facing a hoistway wall 1*a*. The proximity switch 10 projects toward the facing hoistway wall 1*a* from the side wall portion 2*a*.

A landing device 11 for detecting the position in the ascending/descending direction of the car 2 is composed of the landing plate 9 and the proximity switch 10. The landing plates 9 are disposed at of predetermined heights within the hoistway 1 depending upon their intended use. The proximity switch 10 outputs a signal indicating the coupling/uncoupling with the landing plate 9 to thereby detect the height of the car 2 within the hoistway 1. The deceleration point when the car 2 is being raised or lowered, the landing position when the car 2 reaches a floor or the like may be detected according to this detected position.

A control panel 12 is disposed below the lowermost movement position of the proximity switch 10 as shown in FIG. 2. The control panel 12 is provided at the hoistway wall 1*a* through a mounting bracket 13 at a position that is overlapped by the region that is projected from the proximity switch 10 in the ascending/descending direction of the car 2 as shown in FIG. 1. Also, a gap is formed between the surface of the hoistway wall 1*a* and the control panel 12 by the mounting bracket 13. A variety of control devices (not shown) for controlling the drive of the elevator apparatus are provided in the control panel 12. Also, the control panel 12 is connected to each piece of equipment of the elevator apparatus through power lines and signal lines (none of which are shown).

In such an elevator apparatus, the control panel 12 is provided below the lowermost point of travel of the proximity switch 10 at a position where it does not interfere with the proximity switch 10, and (in addition) at the position that is overlapped by the region projected from the proximity switch 10 in the ascending/descending direction of the car 2. Accordingly, the utility efficiency of the building may be enhanced by effectively utilizing a vacant space within the hoistway 1, and at the same time, the machine room may be dispensed with to decrease the height of the building. Moreover, since the vacant space within the hoistway 1 is effectively utilized, it is unnecessary to provide a recess in the car 2. It is therefore unnecessary to reduce the floor area of the cage.

Also, since the control panel 12 is installed on the hoistway wall 1*a* through the mounting bracket 13 with a space between the bottom portion 1*b* of the hoistway 1 and the lower portion of the control panel 12, even if water accumulates in the bottom portion 1*b*, the control panel 12 and the mounting bracket 13 are prevented from being immersed in the water.

Furthermore, since a gap is formed between the surface of the hoistway wall 1*a* and the control panel 12 by the mounting bracket 13, the control panel 12 is prevented from being wet by water falling down the hoistway wall 1*a*.

Furthermore, since a worker may enter the bottom portion 1*b* and may work on the control panel 12 with ease, the maintenance workability is also enhanced.

Second Embodiment

Figure 5:
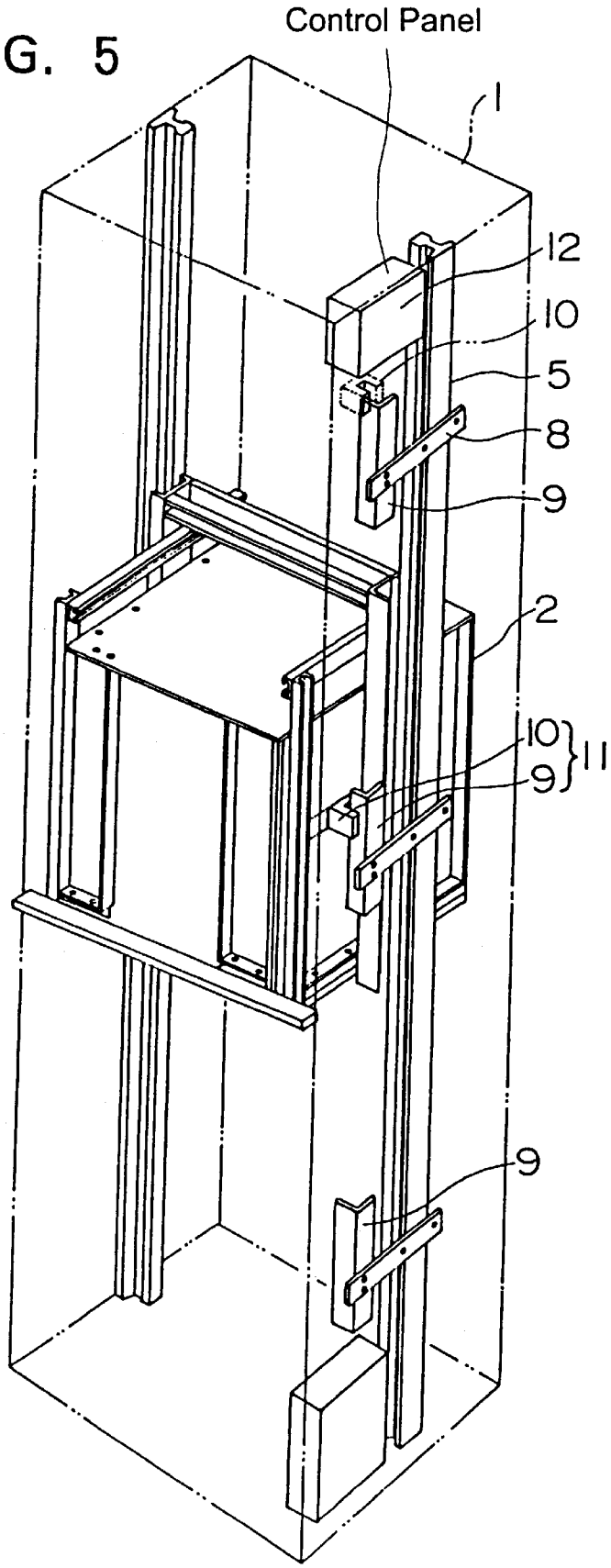
FIG. 5 is a perspective view showing a primary part of an elevator apparatus according to a second embodiment of the present invention.

Further, in the above-described example, the control panel 12 is disposed below the lowermost point of travel of the proximity switch 10. However, as shown in FIG. 5, the control panel 12 may be disposed above the uppermost point of travel of the proximity switch 10 (indicated by broken lines). In this case, since a worker can readily work on the control panel 12 by riding on the top of the car 2, the maintenance workability is enhanced.

Figure 6:
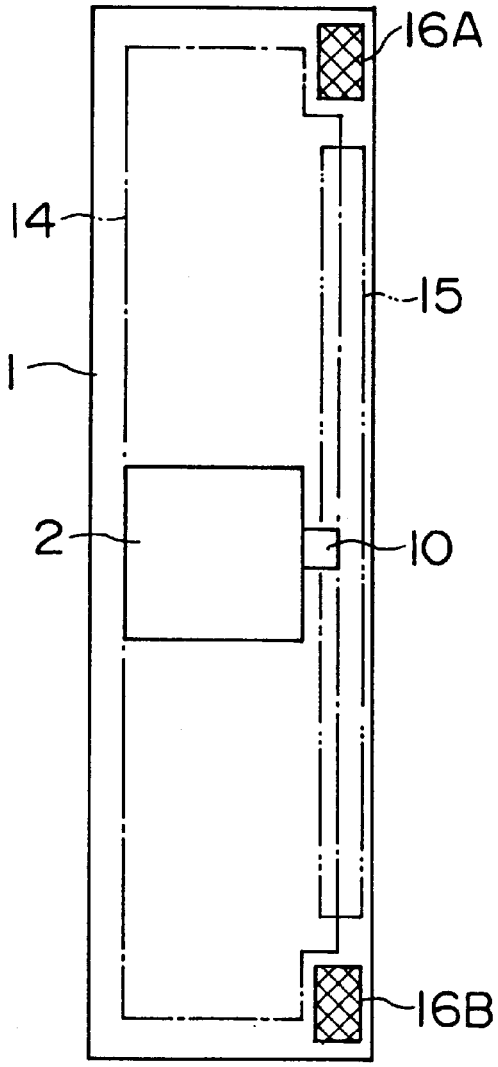
FIG. 6 is an illustration of an installation region for the control panel according to the first and the second embodiments of the present invention.

In the above-described embodiments 1 and 2, as shown in FIG. 6, the control panel is disposed within control panel installable regions 16A and 16B that do not interfere with the movement range 14 of the car 2 and the proximity switch 10 and the hoistway device installation region 15.

Third Embodiment

Figure 7:
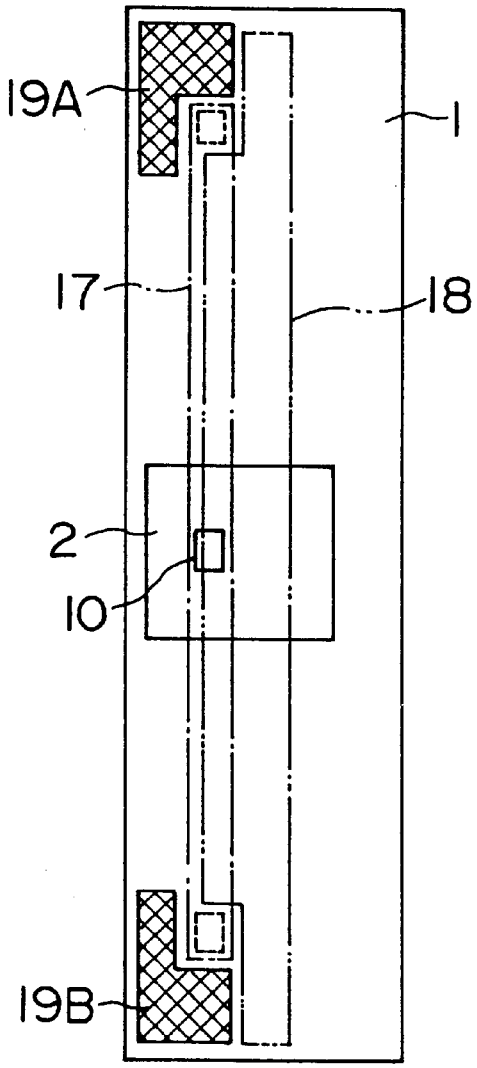
FIG. 7 is an illustration of an installation region for the control panel of an elevator apparatus according to a third embodiment of the present invention.

FIG. 7 is a right side elevational view of FIG. 6. The control panel may be disposed within the control panel installable regions 19A and 19B that do not interfere with the movement range 17 of the proximity switch 10 and the hoistway device installation region 18. Thus, the width, of the control panel installable regions 19A and 19B as viewed laterally in FIG. 7, varies according to position in the height direction. Accordingly, the cross-sectional area of a control panel may be changed to conform to the shape of the installation regions 19A and 19B. Thus, it is possible to reserve a satisfactory space for the control panel.

Further, in the embodiments 1 to 3, the control panel 12 is disposed at a position that is overlapped by the region projected from the proximity switch 10 in the ascending/descending direction of the car 2. However, it is possible to provide the control panel at a position that is not overlapped by the region projected from the carmounted equipment. Namely, in the case where the hoistway device projecting into the hoistway 1 is provided on the hoistway wall 1*a*, it is possible to dispose the control panel at a position where the hoistway device is projected in the ascending/descending direction of the ascending/descending body and out of the hoistway device installation region. For example, in the case where a speed adjuster or a tension pulley is disposed within the hoistway, it is possible to mount the control panel utilizing the space below the tension pulley or above the speed adjuster. Also, in such a case, it is possible to enhance the utility efficiency of the building by effectively utilizing the empty space above a below the hoistway device and at the same time to reduce the height of the building.

Fourth Embodiment

Figure 8:
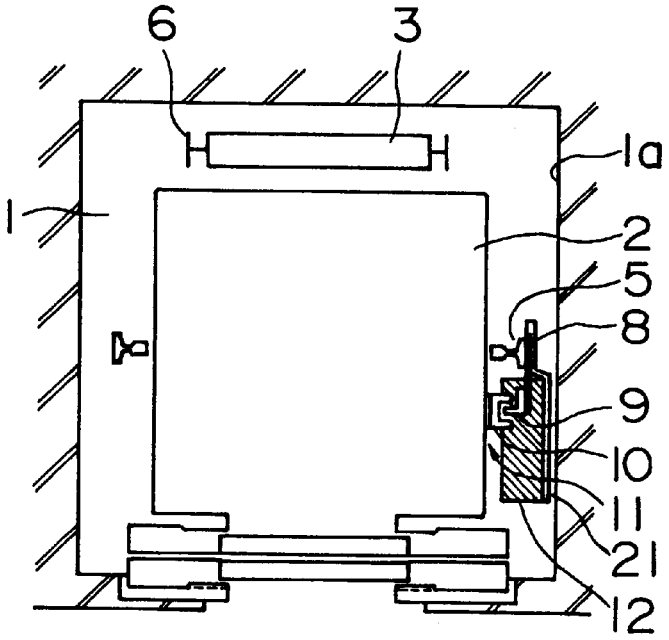
FIG. 8 is a horizontal cross-sectional view of an elevator apparatus according to a fourth embodiment of the present invention.
Figure 9:
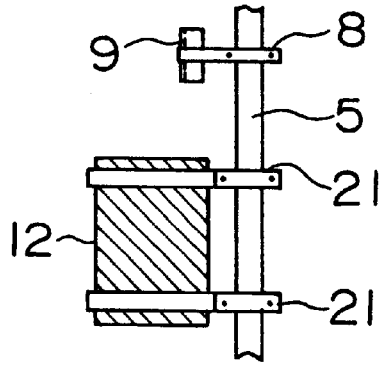
FIG. 9 is a vertical sectional view showing the structure of a primary part of the apparatus shown in FIG. 8.

Next, FIG. 8 is a horizontal sectional view showing an elevator apparatus in accordance with a fourth embodiment of the present invention, and FIG. 9 is a view showing a structure of a primary part of FIG. 8. In this example, the control panel 12 is supported by the car guide rails 5 through a plurality of support beams 21. The other structure is the same as that of the first embodiment.

In such an apparatus, since the control panel 12 is supported by the guide rails 5 which are some of the stronger structural members of the hoistway 1 and which are installed with high precision, the control panel 12 may also be installed securely with high precision.

Fifth Embodiment

Figure 10:
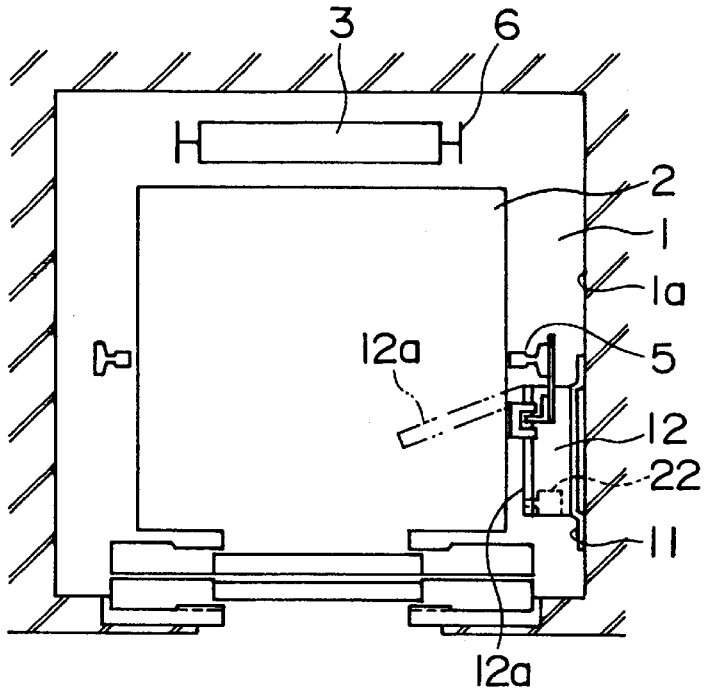
FIG. 10 is a horizontal cross-sectional view of an elevator apparatus according to a fifth embodiment of the present invention.
Figure 11:
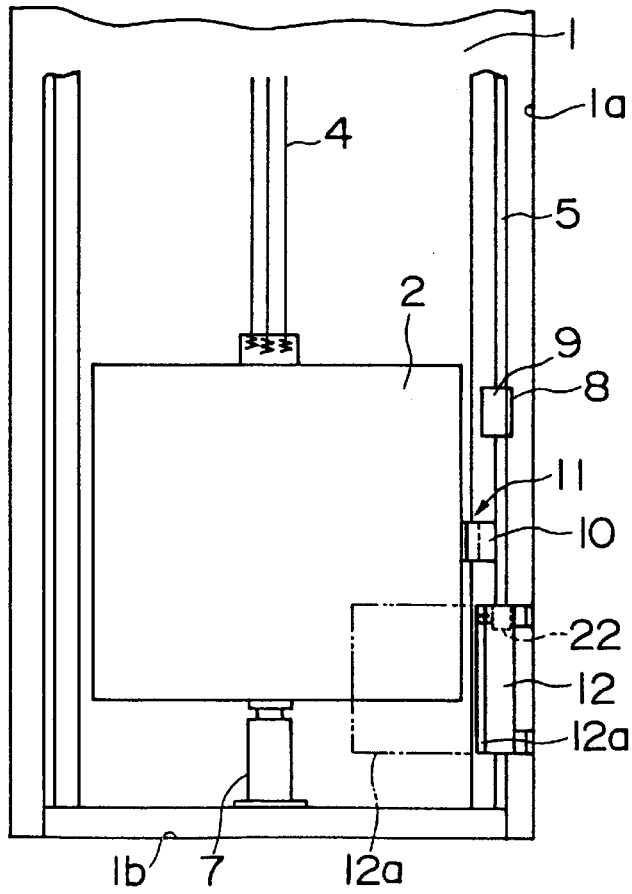
FIG. 11 is a vertical sectional view of the apparatus shown in FIG. 10.

Next, FIG. 10 is a horizontal sectional view showing an elevator apparatus in accordance with a fifth embodiment of the present invention, and FIG. 11 is a vertical sectional view of the apparatus of FIG. 10. In this example, a detection switch 22 for detecting whether a door 12*a* of the control panel 12 is closed is provided on the control panel 12. The detection switch 22 is connected to an management controller (not shown) within the control panel 12, and the operating management mode of the elevator apparatus is switched over to the maintenance mode when the door 12*a* is opened. Also, during operation in the maintenance mode, the ascending/descending range of the car 2 is restricted. The other structure is the same as that of the first embodiment.

In such an apparatus, it is possible to prevent the car 2 from colliding with the opened door 12*a* of the control panel 12 by restricting the lowermost movement position of the car 2 during maintenance mode operation to thereby enhance reliability.

Further, in the case where the control panel 12 is located in the upper portion of the hoistway 1 as shown in FIG. 5, it is possible to avoid a collision between the door 12*a* and the car 2 by restricting the uppermost movement position of the car 2 during operation in the maintenance mode.

Also, in the foregoing embodiments 1 to 5, the proximity switch 10 of the landing device 11 is used as the car-mounted device. However, in the case where at least part of the car-mounted device such as a door device, ventilation device, lamp device or baggage receiving device for receiving a long object or the like projects toward the hoistway wall from the car, it is possible to mount the control panel in the space above or below the movement range of the projecting portion.

What is claimed is:

1. An elevator apparatus comprising:

a hoistway having hoistway wall and a bottom portion;

an ascending and descending body having a side wall portion facing said hoistway wall and a car-mounted device projecting toward said hoistway wall for said side wall portion, said ascending and descending body being raised and lowered within said hoistway; and a control panel for controlling the ascent and descent of said ascending and descending body, said control panel being disposed within said hoistway at a position overlapped by a horizontal cross-section of said car-mounted device projected in ascending and descending directions of said ascending and descending body and out of a range of movement of said car-mounted device in the ascending and descending directions of said ascending and descending body.

2. The elevator apparatus according to claim 1, wherein said control panel is installed below a lowermost movement position of said car-mounted device.

3. The elevator apparatus according to claim 2, including a gap between a lower portion of said control panel and said bottom portion of said hoistway.

4. The elevator apparatus according to claim 1, including a mounting bracket supporting said control panel on said hoistway wall, said mounting bracket having a gap between said control panel and said hoistway wall.

5. The elevator apparatus according to claim 1, wherein said control panel is installed above an uppermost movement position of said car-mounted device.

6. The elevator apparatus according to claim 1, wherein said control panel has a cross-section that varies in a vertical direction to conform with a shape of a control panel installable region that does not interfere with a range of movement of said car-mounted device.

7. The elevator apparatus according to claim 1, including a guide rail for guiding the ascent and descent of said ascending and descending body, installed within said hoistway, and a support beam supporting said control panel on said guide rail.

8. The elevator apparatus according to claim 1, wherein said control panel has an openable door and a detection switch for detecting whether the door is open or closed, an operating management mode of the elevator being switched to a maintenance mode when said door is open to restrict the ascending and descending range of the car.

9. An elevator apparatus comprising:

a hoistway having hoistway wall and a bottom portion;

an ascending and descending body raised and lowered within said hoistway;

a hoistway device located on said hoistway wall and projecting into said hoistway; and a control panel for controlling the ascent and descent of said ascending and descending body, said control panel being disposed within said hoistway at a position overlapped by a horizontal cross-section of said hoistway device projected in ascending and descending directions of said ascending and descending body, and outside of an installation region of said hoistway device.

* * * * *